US005129119A

United States Patent [19]

Sherman

[11] Patent Number: 5,129,119

[45] Date of Patent: Jul. 14, 1992

[54] DIFFUSER EFFICIENCY

[75] Inventor: Michael I. Sherman, Glens Falls, N.Y.

[73] Assignee: Glentech Inc., Glens Falls, N.Y.

[21] Appl. No.: 682,382

[22] Filed: Apr. 9, 1991

[51] Int. Cl.[5] ..... D21D 5/02

[52] U.S. Cl. ..... 8/156; 68/181 R

[58] Field of Search ..... 8/156; 68/181 R; 162/60; 210/106, 137, 143

[56] References Cited

U.S. PATENT DOCUMENTS

| | | | |
|---|---|---|---|
| 3,729,961 | 5/1973 | Leffler | 68/181 R |
| 4,908,896 | 3/1990 | Jacobsen et al. | 8/156 |
| 5,020,178 | 6/1991 | Jacobsen | 8/156 |

*Primary Examiner*—Philip R. Coe
*Attorney, Agent, or Firm*—Nixon & Vanderhye

[57] ABSTRACT

The efficiency of a diffuser, for washing or bleaching paper pulp, is enhanced by taking steps to ensure that the approximate upstroke speed is only slightly faster than the pulp upflow velocity, to provide an early warning indication of the tendency of the diffuser screens to plug, and to prevent upward movement of the screen, after completion of a downstroke, uncontrolled by the hydraulic system designed to effect movement. The pressure under the annular screen is sensed and compared to normal static pressure at the elevation of the screen by a D/P cell in a leg, and a computer controls the hydraulic system so that the screen upstroke speed is only slightly faster than the pulp upward speed. Early detection of a tendency to plug is provided by a pressure sensor within the hollow interior of the screen spaced from the screen orifices. To prevent gas from pushing the screen upwardly, during an initial part of an upstroke, the hydraulic system is operated to effect quick upward movement a small predetermined distance before continuous, smooth movement is effected.

22 Claims, 2 Drawing Sheets

DIFFUSER EFFICIENCY

BACKGROUND AND SUMMARY OF THE INVENTION

Atmospheric diffusers have become a widely accepted technology in the paper pulp treatment art, both for washing and bleaching. While atmospheric diffusers have a wide variety of advantages over other types of washing and bleaching devices, their performance is still not optimum despite continuous development work over the past 25 years. A major aspect of conventional diffusers that could desirably be improved is efficiency, conventional bleaching diffusers having relatively high chemical consumption.

Perhaps the basic reason for any shortcomings in efficiency that do exist in conventional diffusers is that the diffuser does not operate as a perfect displacement machine, but rather only acts as a combination of a mixer and thickener, and only partially is a displacement machine. Ideally, the diffuser operation would consist of a series of individual batch operations, each one being a complete cycle, such that during the diffuser upstroke the pulp and the screen assembly travel at the same speed with relation to each other and are therefore—relatively speaking—stationary. Unfortunately, that ideal does not translate into practice, but rather in actual diffusers the diffuser ends up moving significantly faster than the pulp flowing upwardly in the tower.

It has been determined that during normal operation of a diffuser, the static pressure as measured underneath the diffuser is lower than it would be at the same elevation in the tower without the diffuser. What appears to happen is that the pulp is held between the annular screen assemblies by the pressure differential across the screen. Thus the screen assembly acts like a piston which supports some of the weight of the pulp column above. This results in a region of lower static pressure under the diffuser, and therefore it is easier for some of the liquid from the treatment liquid introduction nozzles to move into the lower region, creating more dilute zones. Consequently, not all of the wash or treatment liquid from the nozzles goes directly across to the screens to displace the dirty liquid, but some of it first gets mixed with the incoming unwashed or untreated pulp. This is one of the major contributing factors to the lower efficiency than is desirable problem mentioned above.

Capacity in existing systems is also somewhat limited by the manner in which the downstroke is initiated. Typically, there is a 3–8 second wait (out of a total stroke time of about 50 seconds) at the top of the stroke when extraction does not take place, in order for the internal and external pressures associated with the screen to equalize, before the downstroke is initiated. For maximum capacity the downstroke should be initiated immediately when the pressure equalizes, rather than waiting a predetermined time period; utilizing a transducer sensing pressure within a screen, it would be possible to know immediately when pressure was equalized, and start the downstroke then. According to the invention, efficiency is enhanced by taking steps to ensure that the upstroke speed of the screen will be only very slightly faster than the pulp. This is accomplished by determining the pressure differential under the diffuser and comparing it to the normal static pressure at that elevation, and then controlling the speed of the upstroke so that the pressure under the diffuser is maintained only slightly below the corresponding static pressure.

According to the invention it is also desirable to enhance the ability to provide an early warning indication of a tendency of the screens to plug. This is accomplished by providing a more sensitive pressure sensor within the hollow interior of the screen, prior to the orifice thereof.

It has also been recognized that sometimes after completion of the downstroke, the diffuser screen has a tendency to jump back up, without assistance from the hydraulic system. The pressure causing the screen to "jump" can be greater than that generated by the hydraulic pump which supplies fluid to the hydraulic system for normally moving the screen assemblies. This "jumping" tendency is typically caused by the presence of carbon dioxide gas generated in the tower, and entrained air in the incoming pulp. Those gases are compressed during the rapid downstroke of the screen assembly, and once the downstroke force has been terminated, the compressed gas expands, pushing the diffuser up faster that it is being driven by the hydraulic system itself. Thus the diffuser at the beginning of the upward stroke does not move at the proper speed in relation to the pulp, increasing the tendency to plug and decreasing efficiency.

According to the invention, the tendency of the diffuser screen assembly to "jump" is arrested by initially causing the cylinder to cause the screen assembly to move upwardly in a sequence of controlled small increments during the upstroke. A simple pressure transducer is provided in the hydraulic line going into the cylinder for the upstroke, and when the pressure transducer indicates that it is the hydraulic oil that is lifting the diffuser up not the pulp, at which point the upward movement then is caused to be smooth.

It is the primary object of the present invention to provide enhanced efficiency for an atmospheric diffuser, and a method of treating the suspension, in the pulp and paper art. This and other objects of the invention will become clear from an inspection of the detailed description of the invention and from the appended claims.

DETAILED DESCRIPTION OF THE DRAWINGS

Figure 1:
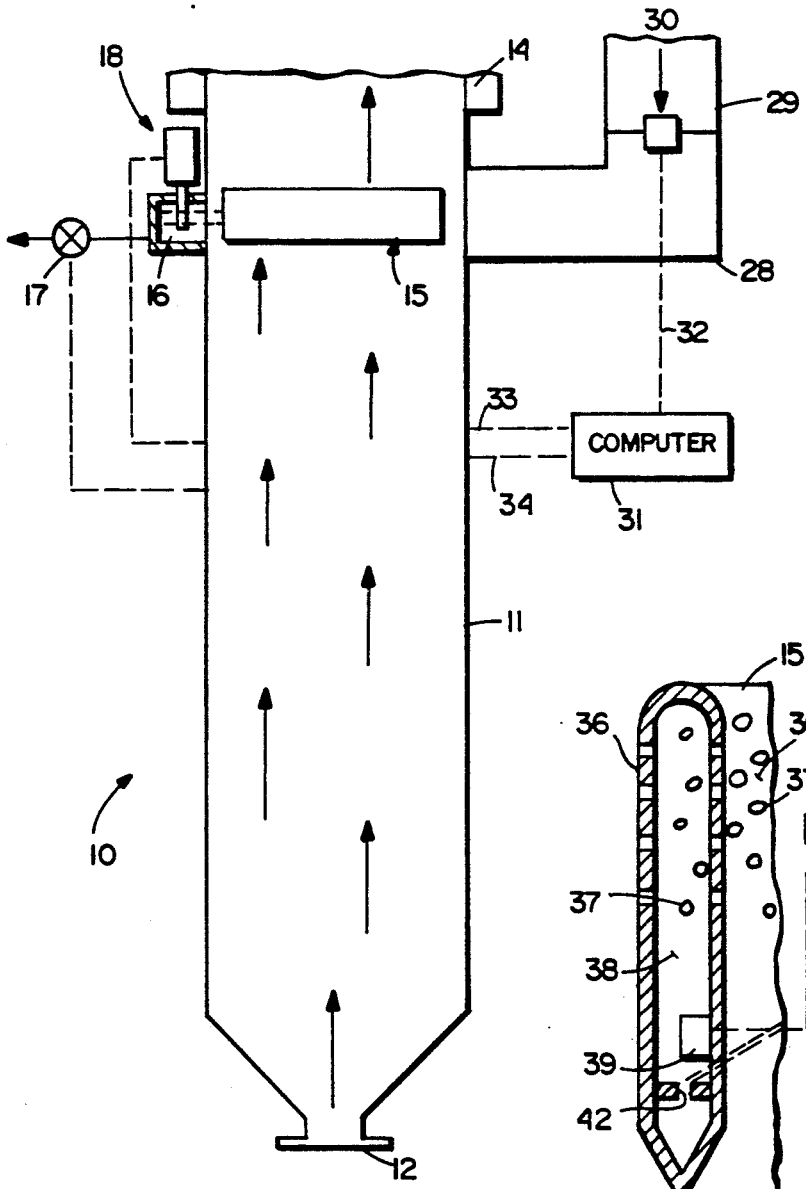
FIG. 1 is a schematic view of an exemplary diffuser according to the invention.

An exemplary atmospheric diffuser according to the present invention is shown generally by reference numeral 10 in FIG. 1. The basic diffuser components are similar to those in long ago issued U.S. Pat. Nos.

3,599,449 and 3,704,603, although enhancements and improvements in details of the structures thereof have been made over the years.

Figure 2:
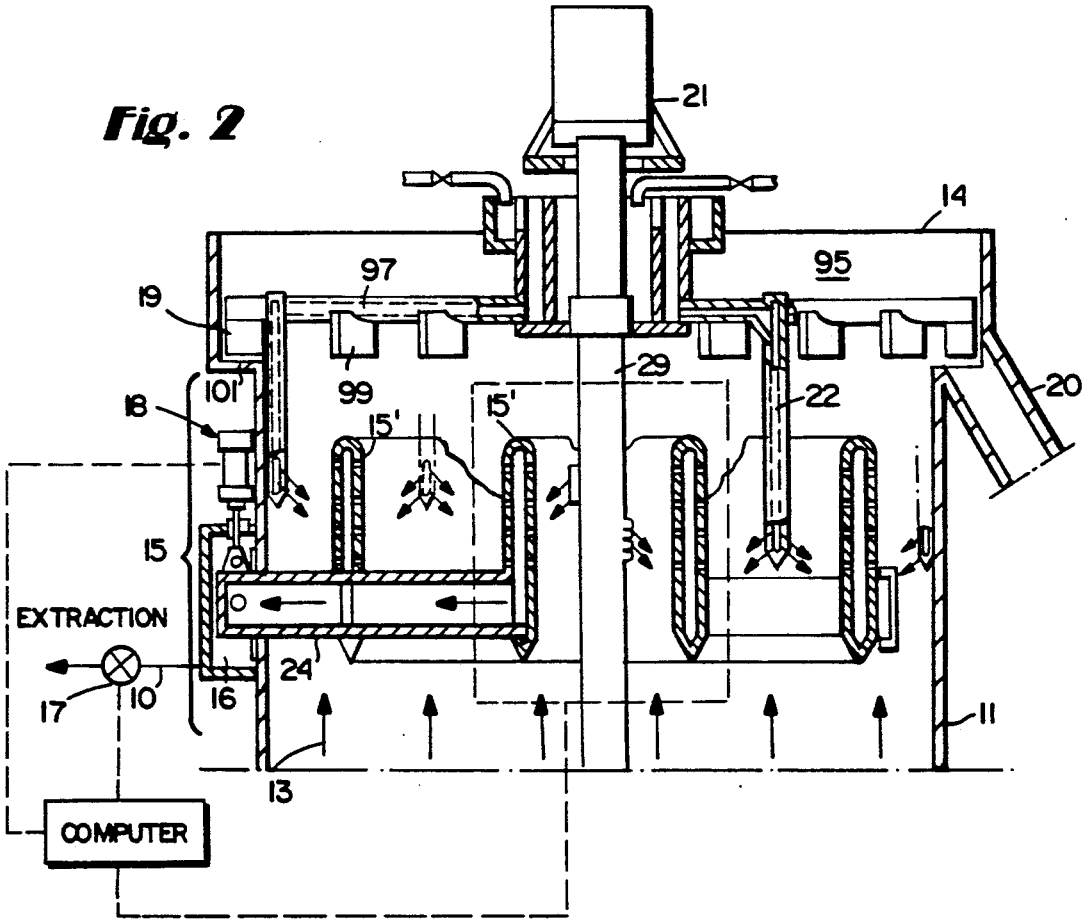
FIG. 2 is a detail cross-sectional view showing the screen assembly and related components for the diffuser of FIG. 1.
Figure 3:
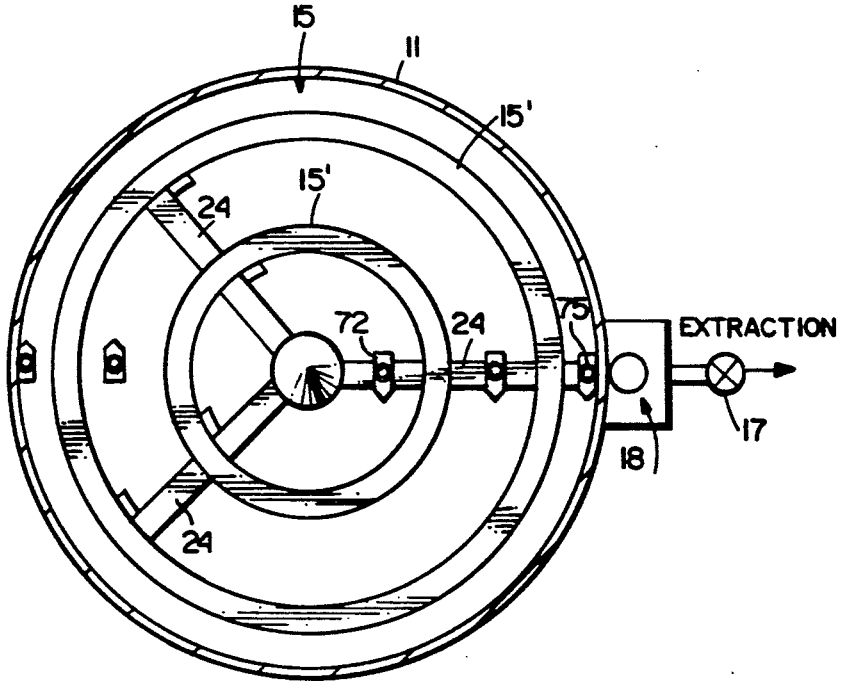
FIG. 3 is a top plan view of the detail components of FIG. 2.

The basic components of the diffuser 10 comprise the vessel or tower 11, which is generally upright, having a means (such as inlet 12) at the bottom thereof for the introduction of pulp to flow upwardly—as indicated by arrows 13 in FIG. 1—in the vessel 11, a pulp discharge trough 14 at the top of the vessel 11, at least one screen assembly 15 (having one or more screen rings 15') mounted within the vessel 11 for up and down movement therein, an extraction conduit 16 and valve 17 for extracting spent treatment liquid that flows into an annular screen 15', and a power means—such as a hydraulic cylinder 18—for effecting up and down reciprocation of the screen assembly 15. As illustrated in FIG. 2, typically a scraper 19 rotates in the trough 14 for effecting discharge of the pulp into pulp outlet 20, the scraper 19 being rotated by the motor 21, and a plurality of treatment liquid introduction tubes 22, or like introduction means, are provided for introducing treatment liquid (typically wash water or bleach) into the pulp as it flows upwardly in tower 11. The screens 15' of assembly 15 are supported by a plurality of radially extending arms 24, at least one of which is connected up to the extraction conduit 16, the arms 24 being hollow, and at least one of the arms being connected up to the power source 18.

What has heretofore been described is conventional. As illustrated schematically in FIG. 1, according to the invention, the pressure under the diffuser assembly 15 is sensed, and that pressure differential is controlled by controlling the speed of the upward movement of the screen assembly 15. In the preferred embodiment schematically illustrated in FIG. 1, the pressure below the screen assembly 15 is sensed utilizing the tower extension 28 which has an upward leg 29 with a conventional differential pressure cell ("D/P cell") 30 mounted therein. The cell 30 senses the pressure difference between the pulp on the bottom thereof and the normal static ambient pressure at the top thereof (for that elevation).

The invention also contemplates the use of a minicomputer 31, or like means, for controlling the power means 18 in response to the D/P cell 30 so that the screen assembly 15 upstroke speed is only slightly faster than the upflowing pulp speed, so that the pressure differential between the area under the screen and the normal static pressure is minimized. The computer 31 will utilize the pressure differential reading from the upper portion of the upstroke, when the operation has reached approximately steady state, to set the speed for the next upstroke. The computer 31 will also, based on the information received, decide if any changes are necessary. For comparison purposes, the computer 31 should have inputted thereto information as to the pulp flow into the tower for rough setting the stroke speed, and to be able to respond quickly to production changes. In this way the treatment liquid introduced by the nozzles 22 does not have a tendency to flow downwardly below the screen assembly 15, but rather treats the pulp as designed. The computer 31 is interconnected by any conventional desirable control lines 32, 33, and 34 to the D/P cell 30, power means 18, and extraction valve 17.

Figure 4:
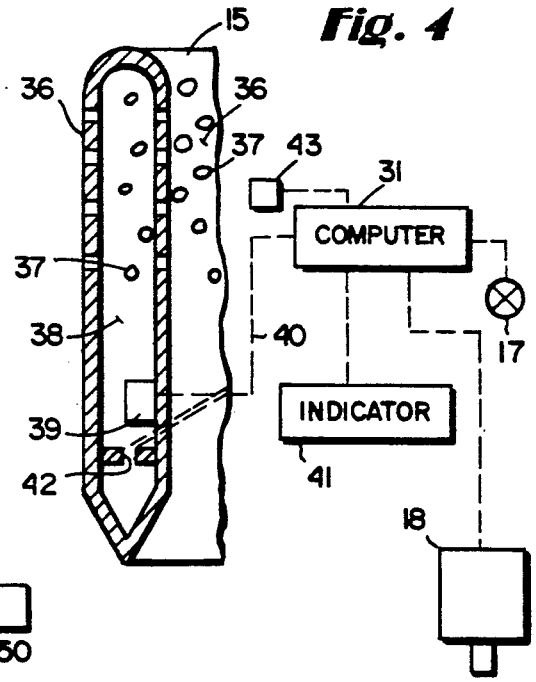
FIG. 4 is a side schematic detail view of an annular screen of the apparatus of FIGS. 1 through 3 with a pressure transducer disposed therein.

In order to provide an early warning system for recognizing screen clogging, the structure as illustrated in FIG. 4 is preferably utilized. As illustrated, the screen assembly 15 includes screen rings 15' having side walls 36 with holes 37 formed in the upper areas thereof, and a hollow interior 38. Actually disposed within the hollow interior 38 is a conventional sensing instrument, like a pressure transducer 39, operatively connected by line 40 to the computer 31. When the pressure within the hollow interior 38 reaches a predetermined value, indicating plugging of the screen 15 is either likely or occurring, in which case the computer 31 can exert control over the power means 18, and/or activate the indicator (e.g. light or alarm) 41, so that corrective action is or can be taken. The transducer 39, or the like, is located just above (prior to) the conventional orifice 42 within the interior 38.

When the sensor 39 senses—compared to a pressure sensor 43 outside the volume 38, but inside vessel 11—that the pressure has equalized, the computer 31 controls actuator 18 to immediately start the downstroke, and extraction (through valve 17), so that the capacity of the diffuser 10 is maximized.

It is not necessary that the sensor 39 itself be located in the volume 38. Rather, it may be operatively in volume 38 if a pressure-transmitting conduit extends from the volume 38 (the location where sensor 39 is in FIG. 4) to outside the vessel 11, through flexible connections, so that the actual sensor is in a less challenging environment. A pressure-transmitting conduit could be used with the sensor 43 too, with the sensor 43 also outside the vessel 11.

Figure 5:
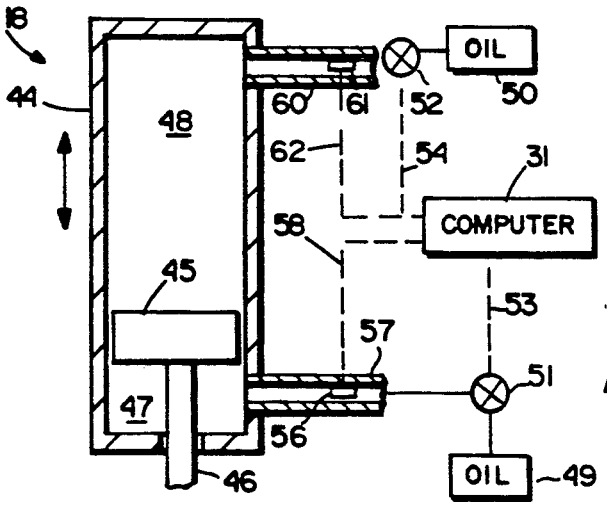
FIG. 5 is a schematic view, partly in cross-section, of a power device for moving the screen assembly of the diffuser of FIGS. 1 through 3, and various control components associate therewith.

In order to minimize the tendency for the screen assembly 15 to "jump" upwardly after a downward stroke (which quickly compresses generated or preexisting gases within the pulp flowing upwardly as indicated by arrows 13), components such as illustrated in FIG. 5 may be utilized. In FIG. 5, the power means 18 is schematically illustrated as a hydraulic cylinder 44 with a piston 45 therein having a rod 46 connected to one of the arms 24. The piston 45 defines a first chamber 47 below it, and a second chamber 48 above it. Hydraulic oil introduced under pressure (e.g. from a pump) into the chamber 47 causes the upward movement of the piston 45, and thus the screen 15, while introduction of hydraulic oil under pressure into the upper chamber 48 causes downward movement of the piston 45 and screens 15. Typically the oil is provided in reservoirs and/or pumps 49, 50, and introduced using controlling valves 51, 52 or like structures now to be controlled by the computer 31 through lines 53, 54, respectively.

In order to minimize the "jumping" action from occurring, once the downstroke has been completed, the initial upstroke of the piston 45 is practiced by controlling the valves 51, 52 so that the piston 45 moves upward quickly a predetermined distance, followed by continuous upward movement at proper (slower) speed. Should there be an indication that there is still a tendency for the screen assembly 15 to "jump", the predetermined distance (e.g. ¾ inch) would be increased by a small increment (e.g. ⅛ inch) by computer 31, and remain there for several cycles to determine if the problem is cleared up. If the problem is not cleared up, another small increment would be added. The reverse is also true; i.e. should the screen assembly 15 exhibit no tendency to "jump", the computer 31 would call for the initial predetermined distance to be decreased by a small increment. In other words, the computer 31 would continuously try to optimize the operation.

The tendency to "jump" can be detected; it exists when the hydraulic pressure in the hydraulic chamber 48 is higher than the set normal operating hydraulic pressure, indicating that the screen assembly 15 is being pushed by the pulp. It also exists if the force required to lift the screen assembly 15 is lower than normal, as indicated by lower hydraulic pressure differential across the piston 45 as measured by the transducers 56 and 61 mounted in the hydraulic lines 57 and 60. The pressure readings from the transducers 56, 61 are fed via line 58, 62 to the computer 31, and once the pressure—or pressure differential—sensed by the transducers 56, 61 is determined to be within the range such that positive control of the upward movement of the piston 45 by the hydraulic system (e.g. elements 49 through 54) is assured, the valves 51, 52 are operated so that hydraulic oil is provided continuously at a smooth, relatively slow (about pulp velocity) speed into the chamber 47, and removed from the chamber 48.

The apparatus 10 as heretofore described is particularly effective in diffusion washing, either with wash liquid or bleach liquid, of paper pulp flowing upwardly within the vessel 11. Utilizing the apparatus 10 heretofore described a method of treating pulp with a treatment liquid (e.g. wash water or bleach) is provided which comprises the steps of substantially continuously:

(a) Introducing the pulp into the bottom of the vessel 11, at inlet 12, to flow upwardly (see arrows 13) in the vessel 11 at a first speed;

(b) Introducing treatment liquid (through nozzles 22) in the vessel to flow through the pulp into the hollow interior of the screen(s) 15';

(c) Extracting spent liquid from the hollow interior 38 of the screen(s) 15' (utilizing the arms 24, extraction conduit 16, and extraction valve 17);

(d) Moving the screen assembly 15 alternately upwardly, and then downwardly at a second speed much greater than the first speed;

(e) Sensing the pressure under the screen assembly 15;

(f) Comparing the sensed pressure under the screen assembly 15 to normal static pressure at the elevation of the screen assembly (utilizing D/P cell 30 and upward leg 29); and (g) In response to step (f), controlling the screen 15 approximate upward speed (via computer 31 and hydraulic cylinder assembly 18) so that it is only slightly faster than the first speed, and so that the pressure differential between the area under the screen 15 and the normal static pressure is minimized. The power means 18 is causes to move—in the upward stroke, initially—quickly a controlled predetermined increment by controlling the valves 51, 52 with the computer 31; which increment can be adjusted until the desired pressure (or differential) is sensed by the transducer 56 (and/or 61); and then the upward movement of the piston 45 becomes smooth and continuous at about said first speed. Early detection of a tendency of the screens 15' to plug is provided by the pressure sensor 39, and downstroke and extraction are initiated immediately when sensors 39, 43 sense that the pressure has been equalized across a screen 15'.

It will thus be seen that according to the present invention the efficiency of a conventional atmospheric diffuser can be improved by bringing the actual operation of the diffuser into closer alignment with theoretical operation thereof. While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A diffusion washing device, comprising a generally upright vessel, a generally annular screen with a hollow interior mounted within said vessel for movement up and down within the vessel, means for extracting spent liquid from the hollow interior of the screen, liquid introducing means for introducing treatment liquid into the vessel to flow to and into the annular screen hollow interior, power means for moving the screen up and down within the vessel, and means for introducing pulp into the vessel to move upwardly in the vessel at a first speed;

means for sensing the pressure under said annular screen;

means for comparing the sensed pressure under said annular screen to normal static pressure at the elevation of said annular screen; and means for controlling said power means in response to said comparing means so that the approximate screen upstroke speed is only slightly faster than said first speed, and so that the pressure differential between the area under the screen and normal static pressure is minimized.

2. A device as recited in claim 1 wherein said annular screen includes an internal orifice which is part of said extraction means; and further comprising means for sensing plugging of said screen, said means comprising a pressure sensing element operatively located within the hollow interior of said screen spaced from said orifice.

3. A device as recited in claim 2 wherein said pressure sensing element comprises a pressure transducer physically positioned within said screen hollow interior prior to said orifice.

4. A device as recited in claim 2 further comprising means for minimizing uncontrolled upward movement of said screen except under the power of said power means.

5. A device as recited in claim 4 wherein said power means comprises a hydraulic cylinder with a piston therein, and with a hydraulic line leading into said cylinder to effect movement of the piston; and wherein said means for minimizing uncontrolled upward movement of said screen comprises pressure sensor in said hydraulic line adjacent said cylinder, said means for controlling said power means causing an initial quick upward movement of a predetermined distance, followed by slower smooth upward movement after the initial quick movement.

6. A device as recited in claim 5 wherein said means for causing movement a predetermined distance comprises in said hydraulic line to change the predetermined distance as necessary to limit movement of said screen to other than under control of said piston.

7. A device as recited in claim 1 wherein said means for controlling said power means comprises a computer.

8. A device as recited in claim 1 further comprising means for minimizing uncontrolled upward movement of said screen except under the power of said power means.

9. A device as recited in claim 1 wherein said means for sensing the pressure under said screen and comparing it to normal static pressure comprises a vertical leg connected to said vessel at said screen, and a differential pressure cell in said leg engaging pulp at a bottom face thereof and the atmosphere at a top face thereof.

10. A diffusion washing device, comprising a generally upright vessel, a generally annular screen with a hollow interior mounted within said vessel for movement up and down within the vessel, means for extracting spent liquid from the hollow interior of the screen including an internal orifice, liquid introducing tubes for introducing treatment liquid into the vessel to flow to and into the annular screen hollow interior, power means for moving the screen up and down within the vessel, and means for introducing pulp into the vessel to move upwardly in the vessel at a first speed; and means for sensing plugging of said screen, said means comprising a pressure sensing element operatively located within the hollow interior of said screen spaced from said orifice.

11. A device as recited in claim 10 wherein said pressure sensing element comprises a pressure transducer physically positioned within said screen hollow interior prior to said orifice.

12. A diffusion washing device, comprising a generally upright vessel, a generally annular screen with a hollow interior mounted within said vessel for movement up and down within the vessel, means for extracting spent liquid from the hollow interior of the screen, liquid introducing tubes for introducing treatment liquid into the vessel to flow to and into the annular screen hollow interior, power means for moving the screen up and down within the vessel, and means for introducing pulp into the vessel to move upwardly in the vessel at a first speed; and means for minimizing uncontrolled upward movement of said screen except under the power of said power means.

13. A device as recited in claim 12 further comprising means for controlling said power means; and wherein said power means comprises a hydraulic cylinder with a piston therein, and with a hydraulic line leading into it to effect movement of the piston; and wherein said means for minimizing uncontrolled upward movement of said screen comprises a pressure sensor in said hydraulic line adjacent said cylinder, said means for controlling said power means causing an initial quick upward movement of a predetermined distance, followed by slower smooth upward movement after the initial quick movement.

14. A device as recited in claim 13 wherein said means for causing movement a predetermined distance comprises a computer connected to said pressure sensor in said hydraulic line to change the predetermined distance as necessary to limit movement of said screen to other than under control of said piston.

15. A method of treating pulp with a treatment liquid utilizing a generally upright vessel having a pulp inlet at the bottom thereof and an outlet at the top thereof, and a screen assembly including at least one annular screen with a hollow interior mounted within the vessel for up and down movement, said method comprising the steps substantially continuously of:

(a) introducing the pulp into the bottom of the vessel to flow upwardly at a first speed;

(b) introducing treatment liquid into the vessel to flow through the pulp into the hollow interior of the screen;

(c) extracting spent liquid from the hollow interior of the screen;

(d) moving the screen assembly alternatively upwardly, and then downwardly at a second speed much greater than the first speed;

(e) sensing the pressure under the screen assembly;

(f) comparing the sensed pressure under the screen assembly to normal static pressure at the elevation of the screen assembly; and (g) in response to step (f), controlling the screen assembly approximate upward speed so that it is only slightly faster than the first speed, and so that the pressure differential between the area under the screen assembly and normal static pressure is minimized.

16. A method as recited in claim 15 comprising the further step of sensing plugging of the screen by sensing the pressure within the hollow interior of the screen.

17. A method as recited in claim 15 wherein step (c) is arrested at the top of the upward stroke, and comprising the further step of comparing the pressure sensed inside the screen to that outside the screen, and when they are equalized immediately initiating downstroke of the screen assembly, and restarting step (c).

18. A method as recited in claim 17 wherein step (d) is practiced utilizing a hydraulic cylinder and piston with a hydraulic line leading thereto, and comprising the further step (h) of minimizing uncontrolled upward movement of the screen assembly except under the power of the piston by initially moving the screen assembly quickly upwardly a predetermined distance, and then continuing upwardly at an approximate speed only slightly faster than the first speed.

19. A method as recited in claim 18 comprising the further step of sensing the pressure in the hydraulic line, and in response to the sensed pressure changing the predetermined distance, if necessary, to minimize movement of the screen assembly except under control of the piston, while maximizing efficiency.

20. A method of treating pulp with a treatment liquid utilizing a generally upright vessel having a pulp inlet at the bottom thereof and an outlet at the top thereof, and a screen assembly including an annular screen with a hollow interior mounted within the vessel for up and down movement, said method comprising the steps substantially continuously of:

(a) introducing the pulp into the bottom of the vessel to flow upwardly at a first speed;

(b) introducing treatment liquid into the vessel to flow through the pulp into the hollow interior of the screen;

(c) extracting spent liquid from the hollow interior of the screen;

(d) moving the screen assembly alternatively upwardly, and then downwardly at a second speed much greater than the first speed utilizing a piston and hydraulic cylinder with a hydraulic line leading thereto; and (e) minimizing uncontrolled upward movement of the screen assembly except under the power of the piston by initially moving the screen assembly quickly upwardly a predetermined distance, and then continuing upwardly at an approximate speed only slightly faster than the first speed.

21. A method as recited in claim 20 comprising the further step of sensing the pressure in the hydraulic line, and in response to the sensed pressure changing the predetermined distance, if necessary, to minimize uncontrolled upward movement of the screen assembly except under control of the piston, while maximizing efficiency.

22. A method of treating pulp with a treatment liquid utilizing a generally upright vessel having a pulp inlet at the bottom thereof and an outlet at the top thereof, and a screen assembly including an annular screen with a hollow interior mounted within the vessel for up and down movement, said method comprising the steps substantially continuously of:

(a) introducing the pulp into the bottom of the vessel to flow upwardly at a first speed;

(b) introducing treatment liquid into the vessel to flow through the pulp into the hollow interior of the screen;

(c) extracting spent liquid from the hollow interior of the screen, but arresting extraction at the top of the upward movement;

(d) moving the screen assembly alternatively upwardly, and then downwardly at a second speed much greater than the first speed;

(e) sensing the pressure inside and outside the screen when the screen assembly is at the top of the upward movement; and (f) in response to (e), when the pressures inside and outside the screen are equalized, immediately initiating downward movement of the screen assembly, and restarting step (c) extraction.

* * * * *